US010615537B2

(12) United States Patent
Shi et al.

(10) Patent No.: US 10,615,537 B2
(45) Date of Patent: Apr. 7, 2020

(54) STACKABLE ELECTRICAL CONNECTOR AND HOUSING FOR THE SAME

(71) Applicant: Tyco Electronics (Shanghai) Co. Ltd., Shanghai (CN)

(72) Inventors: Ming Shi, Shanghai (CN); Hongtao Jiang, Shanghai (CN); Xiaozhi Fu, Shanghai (CN); Wei Zhang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/997,903

(22) Filed: Jun. 5, 2018

(65) Prior Publication Data

US 2018/0351290 A1 Dec. 6, 2018

(30) Foreign Application Priority Data

Jun. 5, 2017 (CN) ..... 2017 2 0644069 U

(51) Int. Cl.

| | |
|---|---|
| ***H01R 13/58*** | (2006.01) |
| ***H01R 13/631*** | (2006.01) |
| ***H01R 24/62*** | (2011.01) |
| ***H01R 13/64*** | (2006.01) |
| ***H01R 13/26*** | (2006.01) |
| ***H01R 13/514*** | (2006.01) |
| ***H01R 13/42*** | (2006.01) |
| *H01R 4/48* | (2006.01) |
| *H01R 11/05* | (2006.01) |
| *H01R 4/26* | (2006.01) |

(52) U.S. Cl.

CPC ..... *H01R 13/5825* (2013.01); *H01R 13/26* (2013.01); *H01R 13/42* (2013.01); *H01R 13/514* (2013.01); *H01R 13/5816* (2013.01); *H01R 13/5829* (2013.01); *H01R 13/631* (2013.01); *H01R 13/64* (2013.01); *H01R 24/62* (2013.01); *H01R 4/26* (2013.01); *H01R 4/4818* (2013.01); *H01R 11/05* (2013.01)

(58) Field of Classification Search

CPC ..... H01R 13/5826; H01R 13/5829; H01R 13/5816; H01R 13/26; H01R 13/4631; H01R 13/64; H01R 24/62; H01R 4/26; H01R 4/4818; H01R 11/05

USPC ..... 439/541.5, 540.1, 461, 460

See application file for complete search history.

(56) References Cited

U.S. PATENT DOCUMENTS 3,789,343 A * 1/1974 Hirokawa ..... H01R 13/28 439/291

4,425,018 A * 1/1984 Stenz ..... H01R 9/2408 439/716

(Continued)

*Primary Examiner* — Harshad C Patel

(74) *Attorney, Agent, or Firm* — Barley Snyder

(57) ABSTRACT

An housing of an electrical connector has at least one accommodation passage passing therethrough. At least one wire is inserted into at least one connection terminal accommodated within the accommodation passage in an insertion direction. The housing has a first surface with a first engagement portion and a second surface, opposite to the first surface, with a second engagement portion matched with the first engagement portion. The first engagement portion or the second engagement portion of the housing is configured to be detachably engaged with a second engagement portion or a first engagement portion of another housing, so as to stack the housing and the another housing together. Thus, it is possible to reduce the space occupied by a plurality of electrical connectors, thereby facilitating management of the wires and the electrical connectors.

11 Claims, 13 Drawing Sheets

(56) References Cited

U.S. PATENT DOCUMENTS 4,682,839 A * 7/1987 Bryce ..... H01R 13/506 439/598
4,753,614 A * 6/1988 Weiner ..... H01R 13/514 439/717
5,288,251 A * 2/1994 Sumida ..... H01R 13/514 439/701
5,643,015 A * 7/1997 Wakata ..... H01R 13/4361 439/701
5,893,778 A * 4/1999 Mansutti ..... H01R 13/514 439/701
5,895,296 A * 4/1999 Okabe ..... H01R 13/514 439/701
5,904,598 A * 5/1999 Yamanashi ..... H01R 12/777 439/354
6,179,653 B1 * 1/2001 Cheng ..... H01R 9/2408 439/541.5
6,193,550 B1 * 2/2001 Yamashita ..... H01R 13/514 439/594
6,264,501 B1 * 7/2001 Hung ..... H01R 27/02 439/541.5
6,332,813 B1 * 12/2001 Okabe ..... H01R 13/514 439/541.5
6,343,960 B1 * 2/2002 Sato ..... H01R 13/514 439/660
6,375,517 B1 * 4/2002 Okabe ..... H01R 13/514 439/594
6,402,568 B1 * 6/2002 Nagai ..... H01R 13/506 439/701
6,619,996 B2 * 9/2003 Hara ..... H01R 13/5221 439/275
6,746,266 B2 * 6/2004 Cheng ..... G02B 6/3879 439/352
6,851,985 B2 * 2/2005 Lafragette ..... H02B 1/26 439/701
6,881,100 B2 * 4/2005 Barry ..... H01R 13/514 439/701
7,316,582 B2 * 1/2008 Fan ..... H01R 13/508 439/540.1
7,404,744 B2 * 7/2008 Amano ..... H01R 13/514 439/540.1
9,362,693 B2 * 6/2016 Martin ..... H01R 24/66
9,673,561 B2 * 6/2017 Imai ..... H01R 13/6272
2002/0076990 A1 * 6/2002 Fujita ..... H01R 13/514 439/701
2015/0255923 A1 * 9/2015 Xu ..... H01R 4/4836 439/345

* cited by examiner

STACKABLE ELECTRICAL CONNECTOR AND HOUSING FOR THE SAME

CROSS-REFERENCE TO RELATED APPLICATION

This application claims the benefit of the filing date under 35 U.S.C. § 119(a)-(d) of Chinese Patent Application No. CN201720644069.7 filed on Jun. 5, 2017.

FIELD OF THE INVENTION

The present invention relates, in general, to a housing for a wire and, in particular, to an electrical connector and a housing for the electrical connector.

BACKGROUND

In an electronic device, two wires are usually connected to a plug connector and a receptacle connector, respectively, to facilitate an electrical connection of the two wires. The electrical connection of the two wires is achieved by mutual engagement between the plug connector and the receptacle connector.

Existing plug connectors and receptacle connectors each comprise a housing and a connection terminal mounted within the housing. For ease of operation, the wires are generally electrically connected to the connection terminal in such a manner that a portion of the connection terminal pokes in a conductor portion of the wire. However, the existing plug connector and receptacle connector are used separately in pair. In case of connecting a plurality of wires, a plurality of plug connectors and a plurality of receptacle connectors are required. However, the plug connector and the receptacle connector in pair are arranged independently, which is inconvenient to be operated and managed.

SUMMARY

Embodiments of the disclosure have been made to provide an electrical connector and a housing for the electrical connector in which a plurality of housings may be stacked together.

According to a first aspect of the present invention, a housing for an electrical connector includes an accommodation passage passing through the housing and through which a wire can pass. This housing also includes a first surface having a first engagement portion and a second surface, opposite the first surface, having a second engagement portion matched with the first engagement portion, with the first engagement portion or the second engagement portion adapted to be detachably engaged with a second engagement portion or a first engagement portion of another housing, so as to stack the housing and the another housing together.

According to a second aspect of the present invention, an electrical connector includes a housing that has an accommodation passage passing through the housing and through which a wire can pass. The housing of this electrical connector also has a first surface having a first engagement portion and a second surface, opposite the first surface, having a second engagement portion matched with the first engagement portion, with the first engagement portion or the second engagement portion adapted to be detachably engaged with a second engagement portion or a first engagement portion of another housing, so as to stack the housing and the another housing together. This electrical connector also has a connection terminal detachably mounted in the accommodation passage and a wire inserted into and electrically connected to the connection terminal.

Advantages of the present invention will become apparent from the following description of the present invention when taken in conjunction with the accompanying drawings, and may give a comprehensive understanding of the disclosure.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENT(S)

Figure 1:
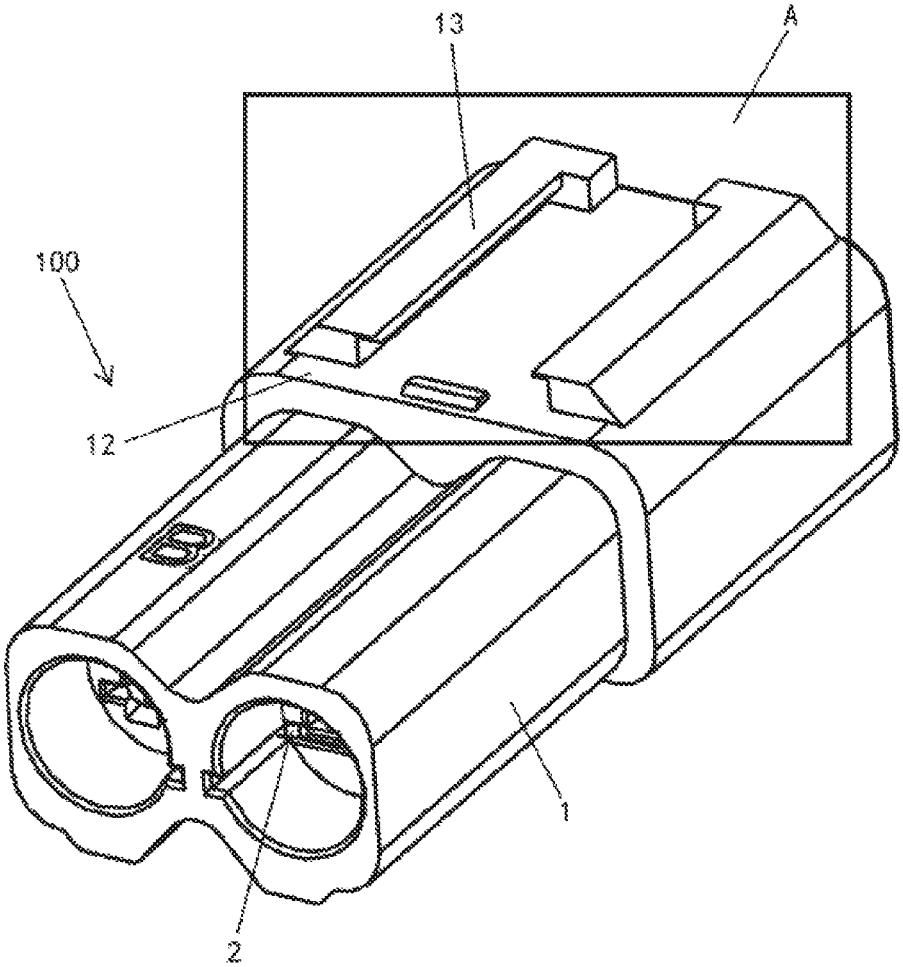
FIG. 1 is a schematic perspective view illustrating an electrical connector according to an exemplary embodiment of the present invention.

The present invention will be described hereinafter in further detail with reference to the following embodiments, taken in conjunction with the accompanying drawings. In the specification, the same or similar reference numerals indicate the same or similar parts. The description of the embodiments of the present invention hereinafter, with reference to the accompanying drawings, is intended to explain the general inventive concept of the present invention and should not be construed as a limitation on the scope of the present invention. In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
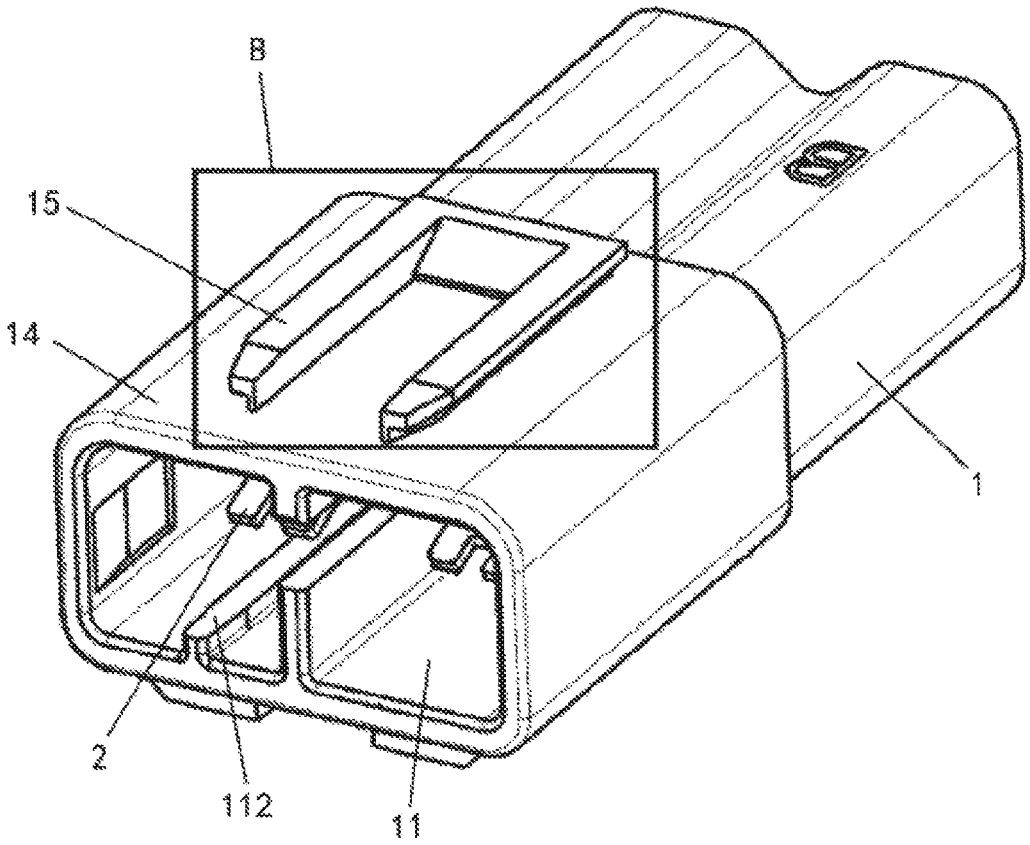
FIG. 2 is another schematic perspective view illustrating the electrical connector shown in FIG. 1 as a plug connector in which connection terminals are shown.

As shown in FIGS. 1 to 4, an electrical connector, according to an exemplary embodiment of the present invention, may be a receptacle connector 100 for connecting a wire 300 (see FIG. 13) as shown in FIGS. 1-2, or may be a plug connector. In the following description, if the electrical connector is the plug connector, a mating connector is the receptacle connector; if the electrical connector is a receptacle connector, the mating connector is the plug connector.

According to an exemplary embodiment of the present invention, referring to FIGS. 1, 2, 6 and 7, the electrical connector comprises a housing 1 and a plurality of connection terminals 2 mounted in the housing. The housing 1 is formed with at least one accommodating passage 11 passing therethrough in a longitudinal direction of the housing 1. At least one wire (see FIGS. 12 and 13) is inserted into the at least one of the connection terminals accommodated in the accommodating passage 11 in an insertion direction (i.e., the longitudinal direction), respectively. The housing 1 has a first surface 12 provided with a first engagement portion 13 and a second surface 14 opposite to the first surface 12. The second surface 14 is provided with a second engagement portion 15 matched with the first engagement portion 13. The first engagement portion 13 or the second engagement portion 15 of the housing 1 is configured to be detachably engaged with a second engagement portion or a first engagement portion of another housing 1' so as to stack the housing 1 and the another housing 1' together. Those skilled in the art should understand that the housing 1 has the same structure as the another housing 1' in FIGS. 7 and 8. In this way, it is possible to stack a plurality of housings with each other.

Figure 6:
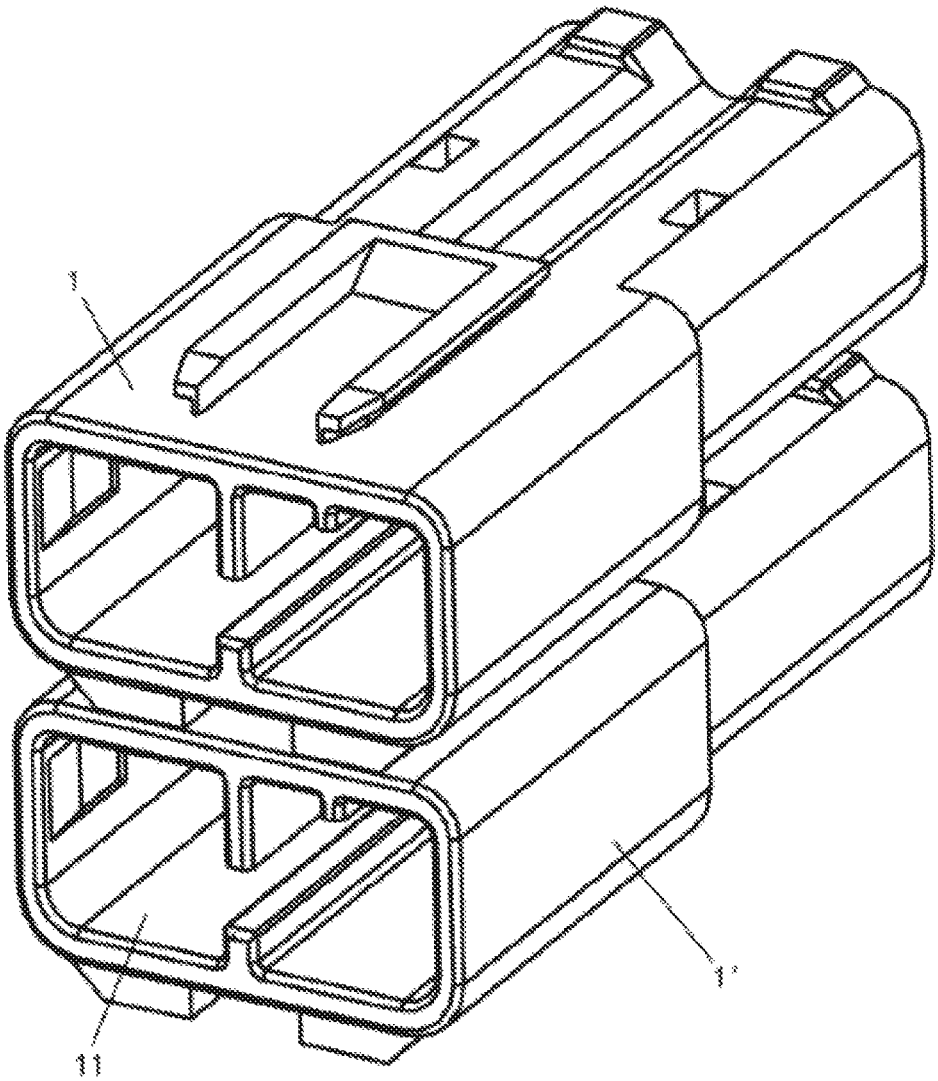
FIG. 6 is a schematic perspective view illustrating two electrical connectors, constructed in accordance with the present invention, stacked together.
Figure 7:
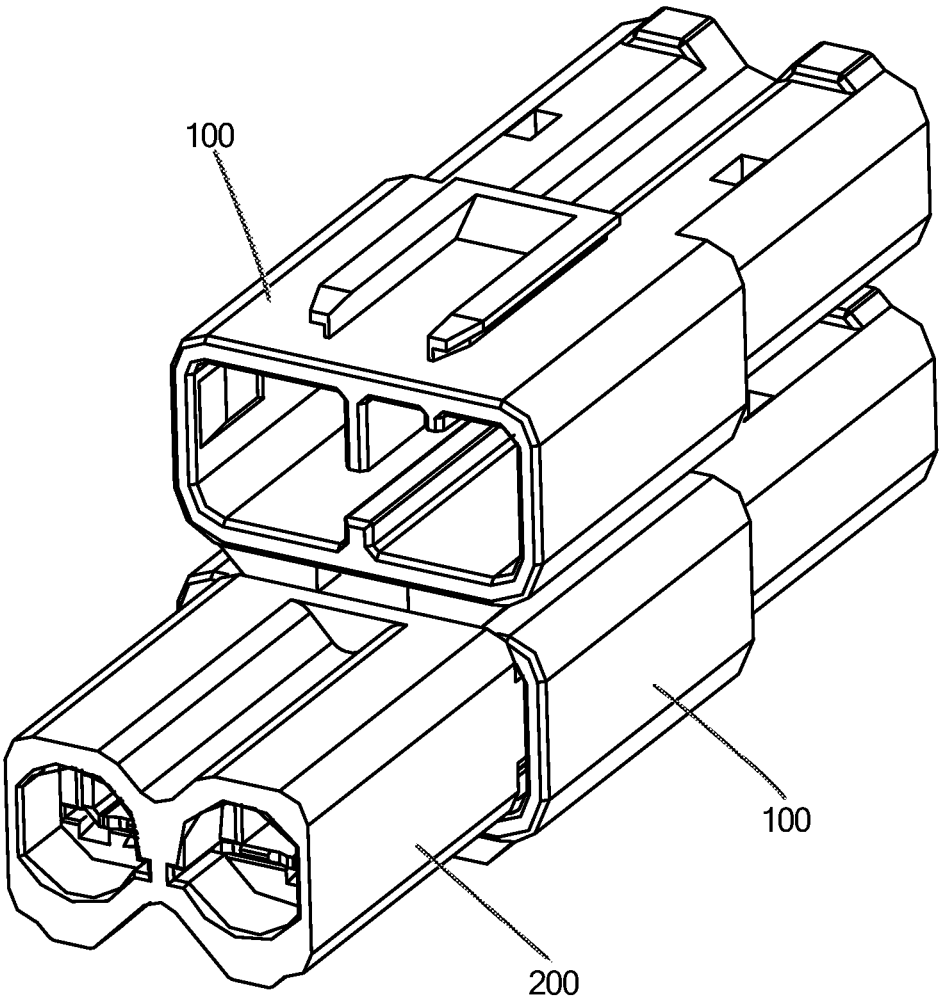
FIG. 7 is a schematic perspective view illustrating one of the two electrical connectors shown in FIG. 6 when being mated with a mating connector.

As shown in FIGS. 1, 2 and 6, in one embodiment, the first engagement portion 13 comprises a receiving portion extending in the insertion direction, and the second engagement portion 15 comprises an insert portion extending in the inserting direction. The insertion portion of the housing 1 is insertable into a receiving portion of the another housing 1' so that the two housings are mounted together.

Figure 8:
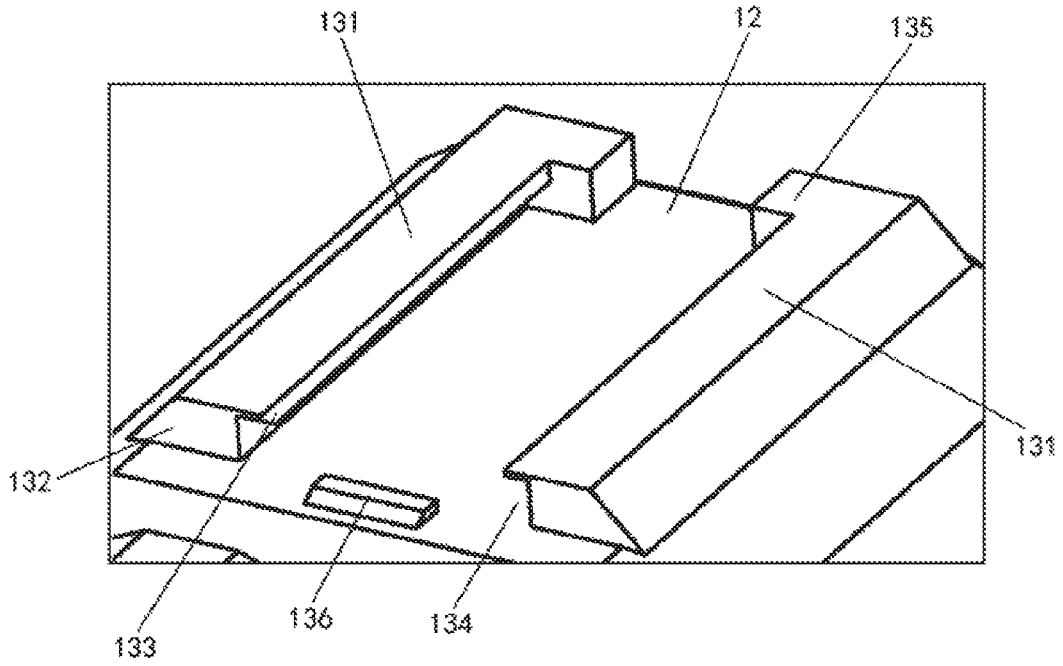
FIG. 8 is a schematic enlarged view of part A of FIG. 1.
Figure 9:
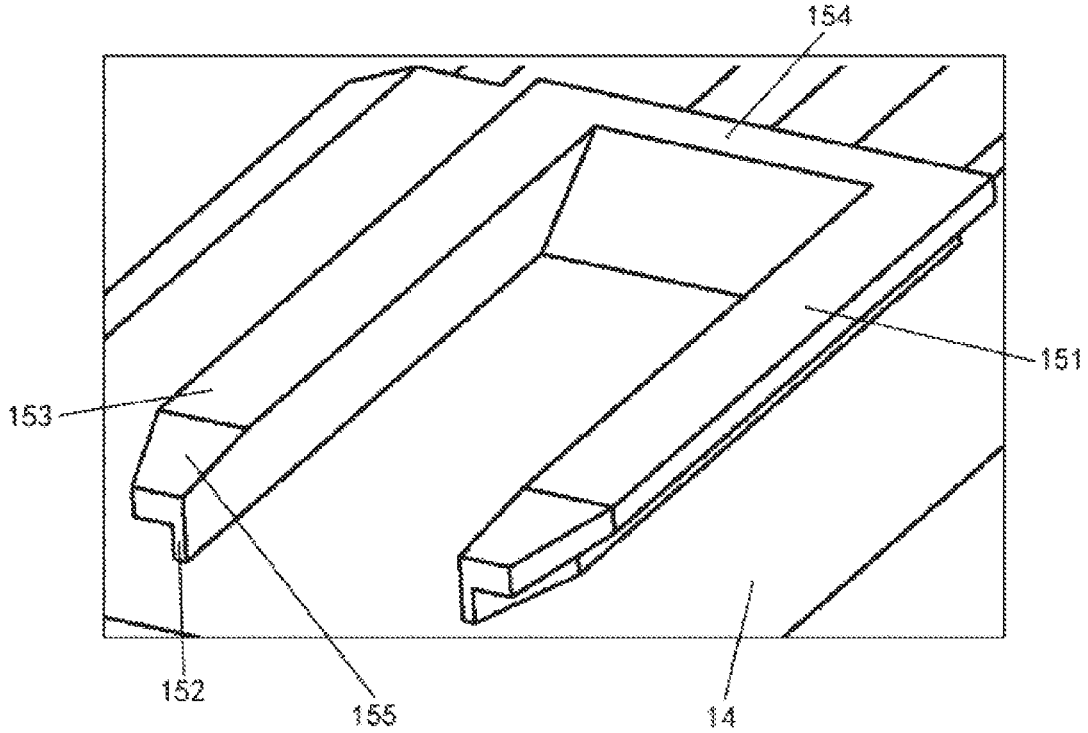
FIG. 9 is a schematic enlarged view of part B of FIG. 2.

FIG. 8 is a schematic enlarged view of part A in FIG. 1 and FIG. 9 is a schematic enlarged view of part B in FIG. 2. As shown in FIGS. 1, 2, 8 and 9, the first engagement portion 13 includes two first frames 131 arranged parallel to the insertion direction and the first frames each have an L-shaped cross-section and include a first connection portion 132 and a first suspension portion 133. The first connecting portion 132 is integrally connected to the first surface 12. The first suspending portion 133 is integrally connected with the first connecting portion 132. The first suspending portions 133 of the two first frames 131 extend toward each other parallel to the first surface 12. The second engagement portion 15 includes two second frames 151 arranged parallel to the insertion direction and the second frames 151 each have an L-shaped cross-section and include a second connection portion 152 and a second suspension portion 153. The second connecting portion 152 is integrally connected to the second surface 14. The second suspending portion 153 is integrally connected with the second connecting portion 152. The second suspending portions 153 of the two second frames 151 extend away from each other parallel to the second surface 14. The second suspension portions 153 of the housing 1 are constructed to be inserted between first suspension portions and a first surface of the another housing 1', while the first suspension portions of the another housing 1' are constructed to be inserted between the second suspension portions and the second surface of the housing 1 so that the housing 1 and the another housing 1' are mounted and stacked together.

With continued reference to FIGS. 8 and 9, in one embodiment, the first frames 131 each include a socket end 134 and a bottom end opposite to the socket end 134. The second frames 151 each include an insertion end and a tail end opposite to the insertion end. The bottom end of the first frame 131 is has a first blocking portion 135 configured to block further insertion of an insertion end of a second frame of the another housing 1', so that the insertion end of the another housing 1' will not be exposed from the bottom end of the first frame 131 of the housing 1.

Further, the first surface 12 has a second blocking portion thereon and the second surface 14 has a mating blocking portion 154 configured to be engaged with a mating blocking portion of the another housing 1' to prevent the another housing 1' from being disengaged from the housing 1.

In one embodiment, the second blocking portion 136 is between the socket ends 134 of the two first frames 131 and the mating blocking portion 154 is between the tail ends of the two second frames 151. Specifically, the second blocking portion 136 projects from the first surface 12 and the mating blocking portion 154 is connected between the tip ends of the two second frames 151 and at least partially suspended. Since the mating stopper 154 is at least partially suspended, it may be elastically bent upon being pressed. In this way, the housing 1 is engaged with the another housing 1', the mating stopper of the another housing 1' may cross over the second blocking portion 136 of the housing 1, and then the second blocking portion 136 of the housing 1 is abutted against an outside of the mating stopper of the another frame 1' to prevent the second frame of the another housing 1' from being disengaged from the first frame 131 of the housing 1. Thus, the two housings may be reliably held together.

In another embodiment, the second blocking portion may have on the first frame 131 and may comprise, for example, a protrusion. Accordingly, the mating blocking portion is on the second frame 151 and may comprise, for example, a groove engaged with the protrusion. When the housing 1 is slidingly engaged with the another housing 1', the projection may be engaged with the groove in a snap fit manner.

As shown in FIG. 9, in an embodiment, the insertion end of the second frame 151 has a ramp structure 155, which facilitates a smooth insertion of the second suspension portion 153 of the second frame 151 of the housing 1 between a first suspension and the first surface of the another housing 1'.

Figure 3:
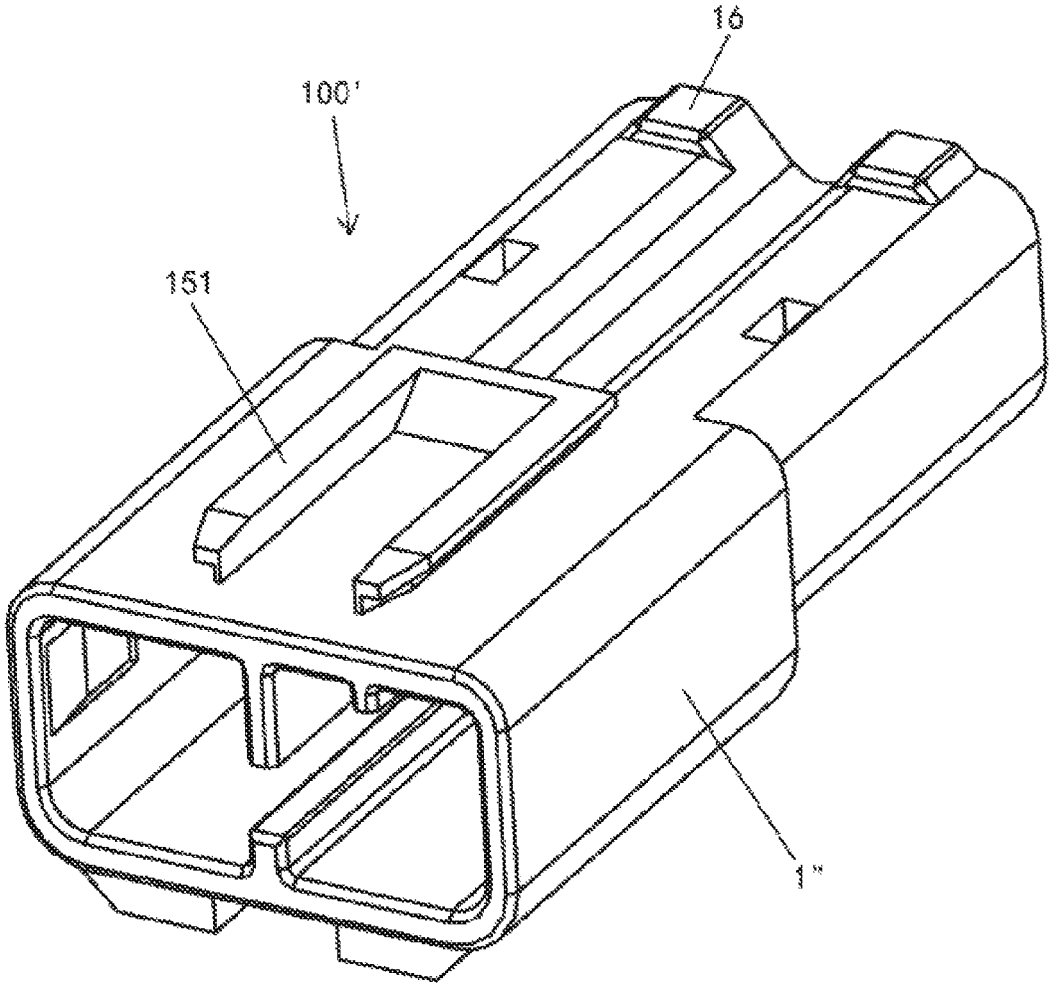
FIG. 3 is a perspective view illustrating an electrical connector according to another exemplary embodiment of the present invention in which a connection terminal is not shown.

FIG. 3 is a schematic perspective view illustrating an electrical connector according to another exemplary embodiment of the present invention in which a connection terminal is not shown. A housing 1" shown in FIG. 3 has a boss 16 having the same height as the second frame 151 so as to maintain a stable engagement between the two housings. The other structures of the housing described with FIG. 3 are the same as or similar to the housing shown in FIG. 1 and the description thereto will be omitted herein.

Figure 14:
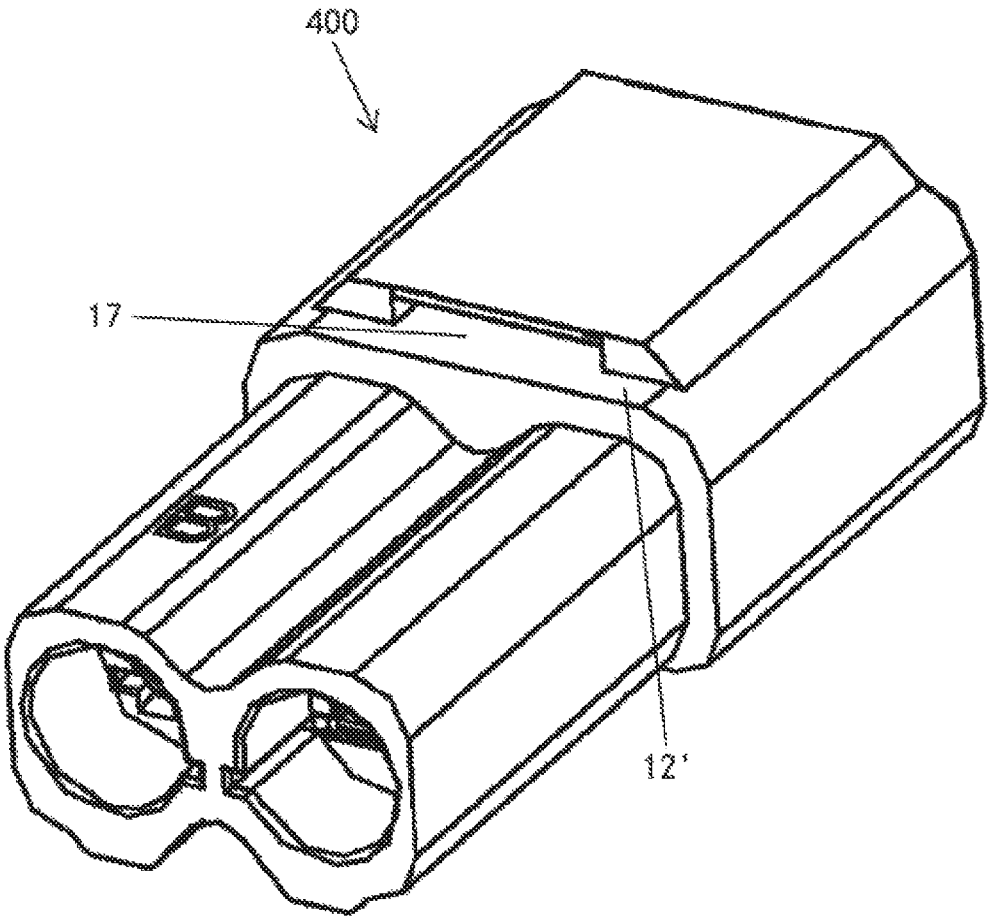
FIG. 14 is a schematic perspective view illustrating an electrical connector according to another exemplary embodiment of the present invention.
Figure 15:
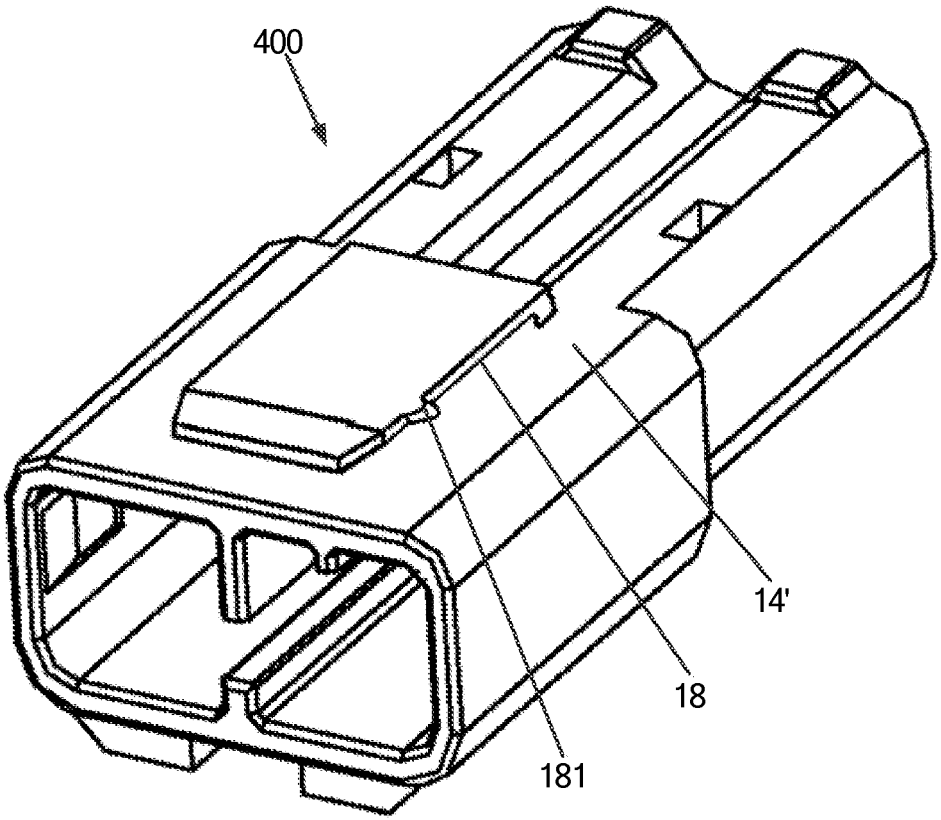
FIG. 15 is another schematic perspective view illustrating the electrical connector shown in FIG. 14.

FIG. 14 is a schematic perspective view illustrating an electrical connector 400 according to another exemplary embodiment of the present invention and FIG. 15 is another schematic perspective view illustrating the electrical connector shown in FIG. 14. Referring to FIGS. 14 and 15, in an exemplary embodiment of the present invention, the electrical connector 400 comprises a housing having a first engagement portion and a second engagement portion. The first engagement portion includes a receiving portion extending in an insertion direction (i.e., a longitudinal direction) of a wire and the second engagement portion includes an insertion portion extending in the insertion direction. The insertion portion of the housing is insertable into a receiving portion of another housing. The receiving portion includes an insertion hole 17 on the first surface 12'. The insertion portion includes a cantilever 18 on the second surface 14' and insertable into an insertion hole of the another housing, thereby stacking the two housings together.

In one embodiment, the cantilever 18 of the housing is inserted into an insertion hole of the another housing in a snap-fit manner. For example, the cantilever 18 has a protrusion 181. The protrusion 181 may be engaged with a groove in the insertion hole of the another housing so that the cantilever 18 of the housing is inserted into the insertion hole of the another housing in the snap-fit manner.

Figure 5:
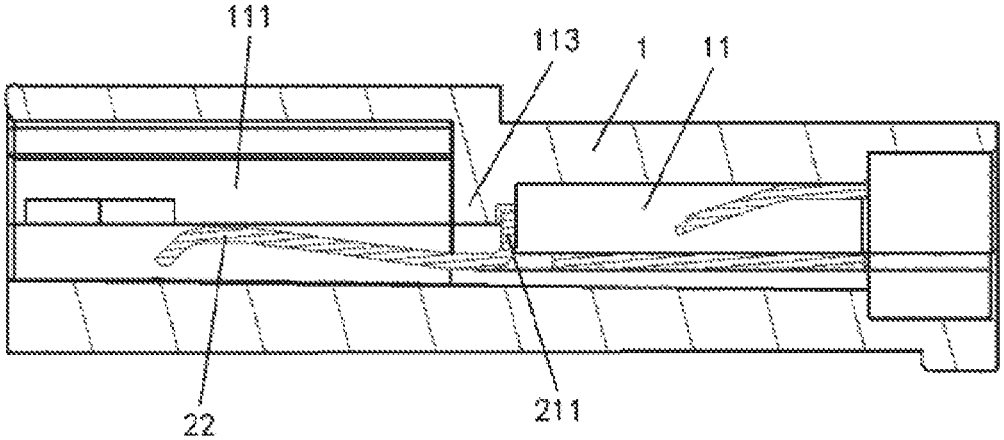
FIG. 5 is a longitudinal sectional view illustrating the electrical connector shown in FIG. 2.
Figure 10:
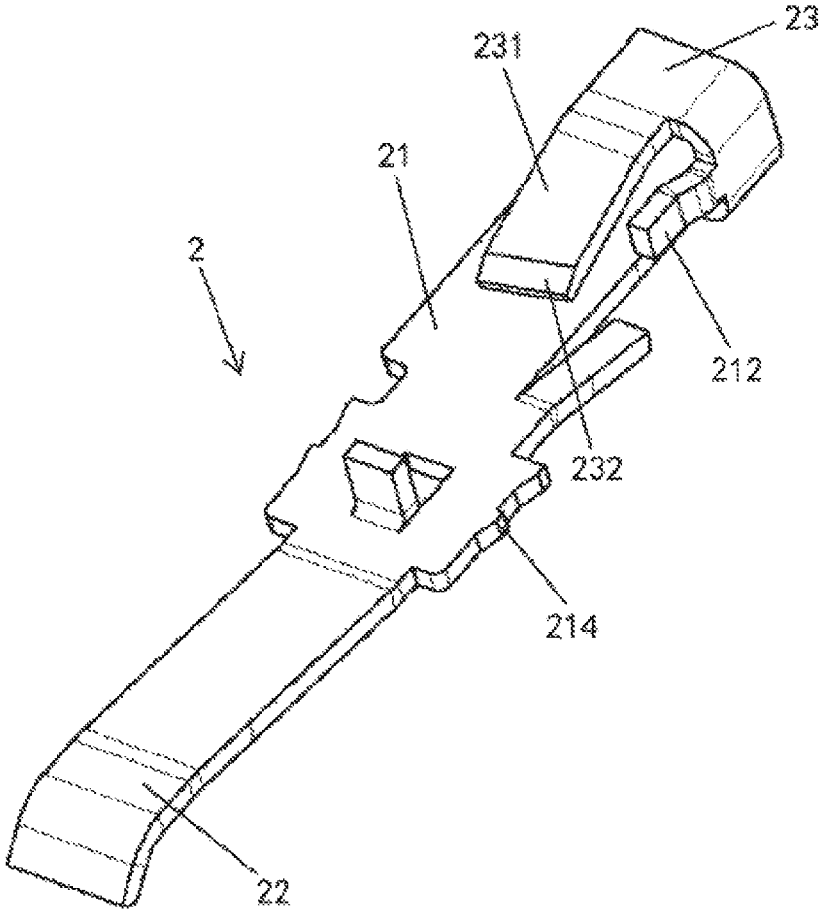
FIG. 10 is a schematic perspective view illustrating a connection terminal of the electrical connector shown in FIG. 1.
Figure 11:
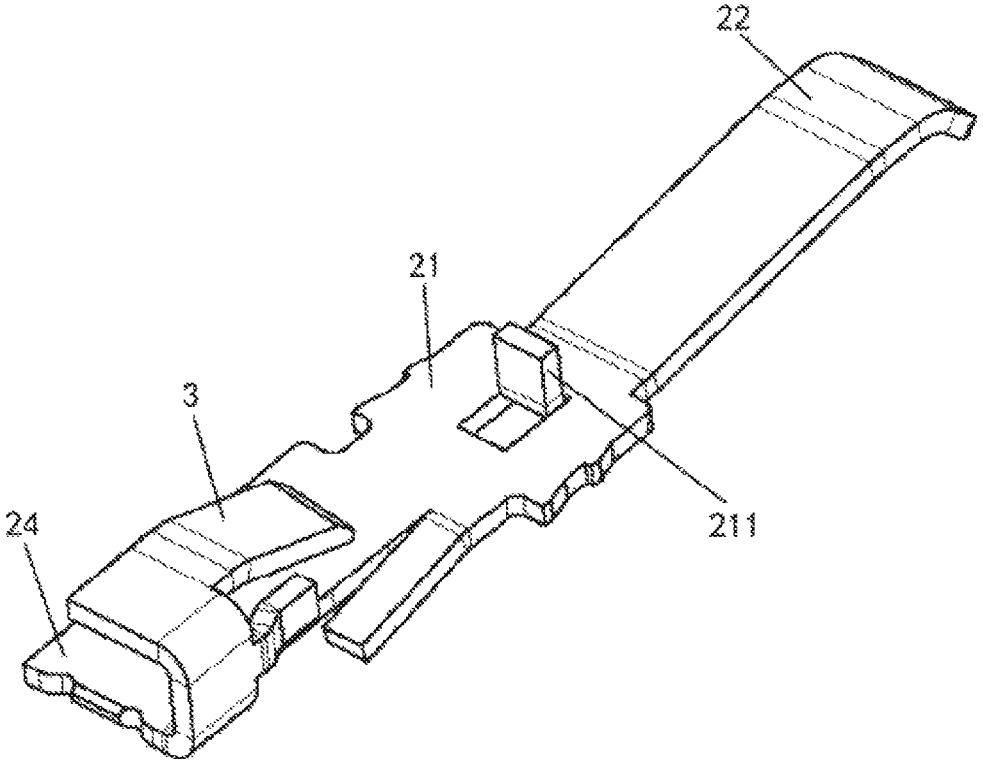
FIG. 11 is another schematic perspective view illustrating the connection terminal shown in FIG. 10.
Figure 12:
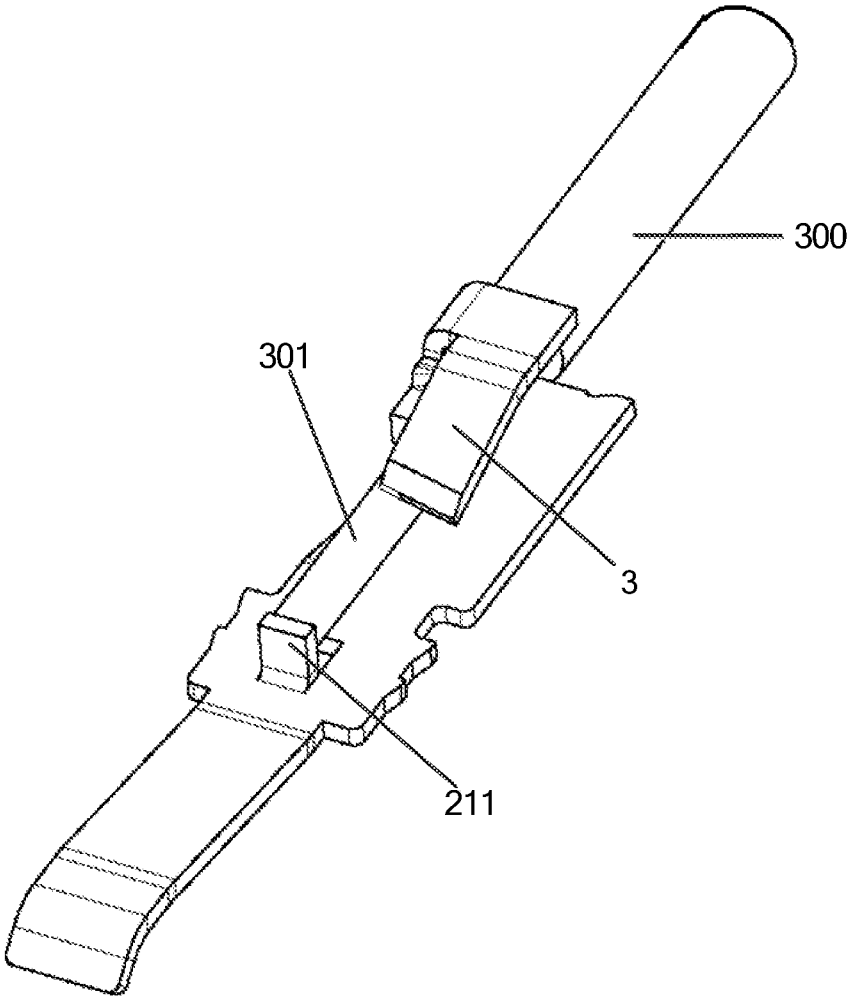
FIG. 12 is a schematic perspective view illustrating the connection terminal shown in FIG. 10 when being connected a wire.
Figure 13:
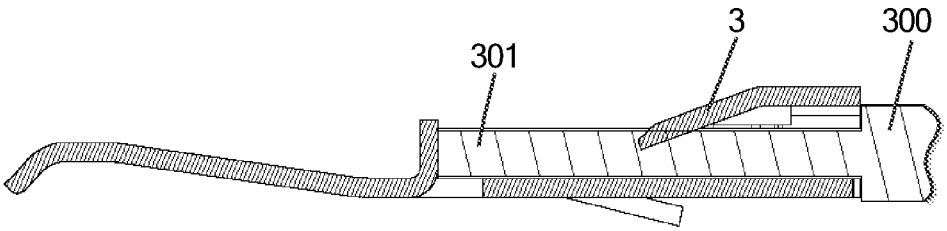
FIG. 13 is a longitudinal sectional view of the FIG. 12 connection terminal.

FIG. 5 is a longitudinal sectional view illustrating the electrical connector shown in FIG. 2. FIG. 10 is a schematic perspective view illustrating a connection terminal of the electrical connector shown in FIG. 1. FIG. 11 is another schematic perspective view illustrating the connection terminal shown in FIG. 10. FIG. 12 is a schematic perspective view illustrating the connecting terminal shown in FIG. 10 when being connected with the wire. FIG. 13 is a longitudinal sectional view of FIG. 12.

Referring to FIGS. 5, and 10 to 13, the connection terminal 2 may be made of a metal sheet such as copper or stainless steel. The connection terminal 2 is detachably mounted in the accommodation passage 11 of the housing 1 and includes: a generally flat body portion 21 onto which a wire 300 is electrically connected (see FIGS. 12 and 13); a contact portion 22 extending from the body portion 21 to be electrically connected with a mating terminal of a mating electrical connector 200; a clamping portion 23 on the body portion 21 and cooperating with the body portion 21 to clamp the wire 300; and a release portion 24 on the clamping portion 23 to release the clamped wire 300.

In one embodiment, the clamping portion and the body portion 21 are connected integrally and have a substantially U-shaped cross-section in a direction perpendicular to the insertion direction of the wire 300 (i.e., a transverse direction or width direction) and an opening of the U-shaped cross-section has the release portion 24 through which the wire 300 may be detached from the connection terminal 2.

In a further exemplary embodiment of the connection terminal 2, the clamping portion 23 has a cantilever 231 obliquely extending at a side thereof located downstream of the insertion direction. The cantilever 231 obliquely extends from the clamping portion 23 toward the body portion 21. The cantilever 231 has a free end formed as a sharp portion 232 in contact with the wire 300. A stopper 211 is at a position on the body portion 21 away from the clamping portion 3 to limit an insertion length of the wire 300 into the connection terminal. A connection portion between the clamp portion 23 and the body portion 21 has an auxiliary positioning portion 212 extending in the insertion direction. In this way, after peeling a protective layer of the wire 300 to expose a conductor portion 301 thereof, the wire 300 is inserted into the connection terminal 2 in the inserting direction near the connection portion between the clamping portion 23 and the body portion 21. The auxiliary positioning portion 212 may further hold the wire within the body portion 21. When a front end of the wire 300 is moved to be in contact with the stopper 211, the stopper 211 will prevent a further movement of the wire in the insertion direction from being generated, thereby limiting the insertion length of the wire into the connection terminal 2.

In addition, the body portion 21 has at least one holding protrusion 214 at either side thereof for stably holding the connection terminal 2 in the accommodation passage 11 of the housing 1. As shown in FIG. 5, when the connection terminal 2 is mounted in the housing 1, the stopper 211 is abutted against a protrusion 113 on an inner wall of the accommodation passage 11. Thus, it is possible to prevent the further movement of the connection terminal 2 from being generated under the push of the wire 300.

As shown in FIGS. 12 and 13, the connection terminal 20 to which the wire 300 is connected may be removed from the housing 1. Thereafter, the wire 300 is rotated and moved toward the release portion 24 and finally the wire 300 is removed from the connection terminal 2. After a fresh wire is mounted on the connection terminal, the connection terminal to which the fresh wire is connected is inserted into the housing. It should be understood that the wire 300 may be inserted into and secured on the connection terminal 2 after the connection terminal 2 is inserted into the housing 1 without being connected with the wire.

Figure 4:
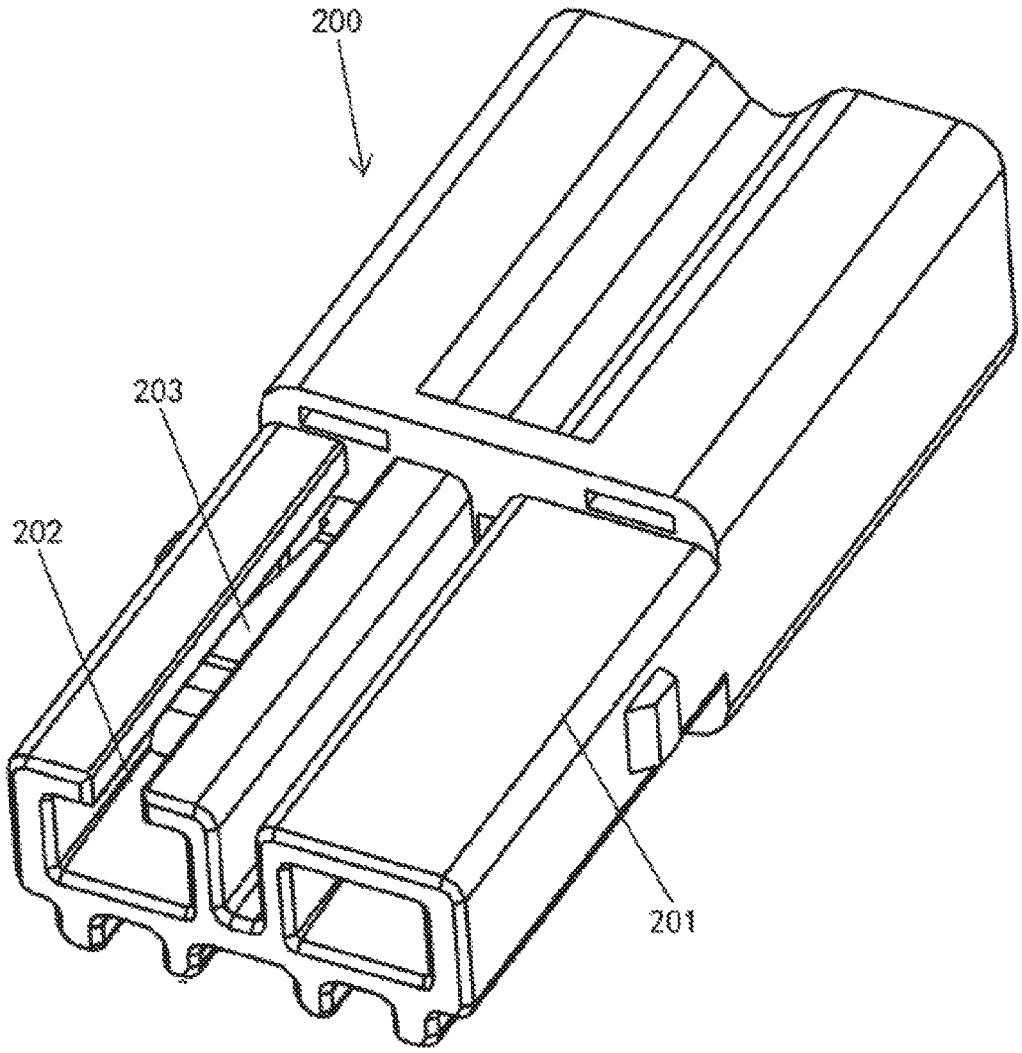
FIG. 4 is a schematic perspective view illustrating a mating connector mated with the electrical connector shown in FIG. 1.

The electrical connector of the present invention will be described below taking an embodiment in which the electrical connector is the receptacle connector 100 as shown in FIGS. 1 and 2 and the mating connector is the plug connector 200 mated with the plug connector as shown in FIG. 4 as an example. The plug connector 200 comprises a plurality of connection terminals and the connection terminals of the receptacle connector have the same structure as that of the plug connector. That is, the connection terminal 2 according to the present invention may be applied to the receptacle connector 100 as well as the plug connector 200, which may reduce manufacturing cost of the receptacle connector 100 and the plug connector 200.

As shown in FIGS. 1, 2, and 5, the accommodation passage 11 of the housing of the receptacle connector 100 includes two accommodation passages 11, each of which includes a receptacle passage 111 in which the contact portion 22 of the connecting terminal 2 is disposed. The receptacle passage 111 has a guide protrusion 112 against which the free end of the contact portion 22 of the connection terminal 2 is abutted. On the other hand, as shown in FIG. 4, in the mating connector (i.e., the plug connector) 200, the connection terminal 203 is mounted in the accommodation passage of the housing 201 and the housing 201 has a guide groove 202. When the plug connector 200 is mated with the receptacle connector 100, the guide protrusion 112 of the receptacle connector 100 is movable in the guide groove 202 so that the contact portions of the receptacle connector and the plug connector are mechanically and electrically connected with each other.

In the housing and the electrical connector according to the above various embodiments of the present invention, since the first engagement portion or the second engagement portion is configured to be detachably engaged with the second engagement portion or the first engagement portion of the another housing, the housing may be stacked with the another housing together. In this way, it is possible to sequentially stack a plurality of electrical connector together to prevent a plurality of wires from being intertwined.

In addition, since the connection terminal may be removed from the housing by operation and has the release portion thereon, it is possible to remove the wire secured onto the connection terminal by a simple operation without any damage to the connection terminal and then to replace a new wire. This eliminates the need to discard the entire connection terminal with the broken wire. Thus, the connection terminal may be reused, thereby saving cost of the entire electrical connector.

It should be appreciated by those skilled in this art that the above embodiments are intended to be illustrative and many modifications may be made to the above embodiments by those skilled in this art and various structures described in various embodiments may be freely combined with each other without conflicting in configuration or principle.

After the preferred embodiments of the present invention are described in detail, it would be appreciated by those skilled in the art that various changes or modifications may be made to these embodiments without departing from the principles and spirit of the present invention, and the present invention will not be limited to the exemplary embodiments above described.

What is claimed is:

1. A housing for an electrical connector comprising:

an accommodation passage passing through the housing and through which a wire can pass; and a first surface having a first engagement portion and a second surface, opposite the first surface, having a second engagement portion matched with the first engagement portion, with the first engagement portion or the second engagement portion adapted to be detachably engaged with a second engagement portion or a first engagement portion of another housing, so as to stack the housing and the another housing together, the first engagement portion has two first frames arranged parallel to an insertion direction, each first frame has an L-shaped cross-section and includes:

(1) a first connection portion connected to the first surface, and (2) a first suspension portion connected with the first connection portion and extending parallel to the first surface; and the second engagement portion has two second frames arranged parallel to the insertion direction, the second frames each have an L-shaped cross-section, are spaced apart from each other in a direction perpendicular to the insertion direction, and each include:

(1) a second connection portion connected to the second surface, and (2) a second suspension portion connected with the second connection portion, extending away from the other second suspension portion and parallel to the second surface, and adapted to be inserted between first suspension portions on a first surface of the another housing.

2. The housing according to claim 1, wherein the first engagement portion has a receiving portion and the second engagement portion has an insertion portion to be inserted into a receiving portion of the another housing.

3. The housing according to claim 1, wherein:

(a) the first frames each have a socket end and a bottom end opposite to the socket end, (b) the second frames each have an insertion end and a tail end opposite to the insertion end, and (c) the bottom end of the first frame has a first blocking portion that blocks further insertion of an insertion end of a second frame of the another housing.

4. The housing according to claim 3, wherein:

(a) the first surface has a second blocking portion, and (b) the second surface has a mating blocking portion that is engaged with a mating blocking portion of the another housing to prevent the another housing from being disengaged from the housing.

5. The housing according to claim 4, wherein:

(a) the second blocking portion is between the socket ends of the two first frames, and (b) the mating blocking portion is disposed between the tail ends of the two second frames.

6. The housing according to claim 5, wherein:

(a) the second blocking portion projects from the first surface, (b) the mating blocking portion is connected between the tail ends of the two second frames and is at least partially suspended, (c) a mating stopper of the another housing crosses over the second blocking portion of the housing, and (d) the second blocking portion of the housing is abutted against an outside of the mating frame of the another frame.

7. The housing according to claim 4, wherein the second blocking portion is on the first frame and the mating blocking portion is on the second frame.

8. The housing according to claim 3, wherein the insertion end of the second frame has a ramp structure.

9. An electrical connector comprising:

a housing comprising:

(a) an accommodation passage passing through the housing and through which a wire can pass, (b) a first surface having a first engagement portion and a second surface, opposite the first surface, having a second engagement portion matched with the first engagement portion, with the first engagement portion or the second engagement portion adapted to be detachably engaged with a second engagement portion or a first engagement portion of another housing, so as to stack the housing and the another housing together, the first engagement portion has two first frames arranged parallel to an insertion direction, each first frame has an L-shaped cross-section and includes:

(1) a first connection portion connected to the first surface, and (2) a first suspension portion connected with the first connection portion and extending parallel to the first surface; and the second engagement portion has two second frames arranged parallel to the insertion direction, the second frames each have an L-shaped cross-section, are spaced apart from each other in a direction perpendicular to the insertion direction, and each include:

(1) a second connection portion connected to the second surface, and (2) a second suspension portion connected with the second connection portion, extending away from the other second suspension portion and parallel to the second surface, and adapted to be inserted between first suspension portions on a first surface of the another housing;

a connection terminal detachably mounted in the accommodation passage; and a wire inserted into and electrically connected to the connection terminal.

10. The electrical connector according to claim 9, wherein the connection terminal has:

(a) a body portion onto which the wire is electrically connected, (b) a contact portion extending from the body portion adapted to be electrically connected with a mating terminal of a mating electrical connector, (c) a clamping portion on the body portion and with the body portion clamping the wire, and (d) a release portion on the clamping portion to release the clamped wire.

11. The electrical connector according to claim 9, wherein the electrical connector has a receptacle connector or a plug connector.

* * * * *